US005593332A

United States Patent [19]

Green

[11] Patent Number: 5,593,332

[45] Date of Patent: Jan. 14, 1997

[54] ICE PENETRATING COMMUNICATION BUOY

[75] Inventor: Jeffry H. Green, S. Elgin, Ill.

[73] Assignee: Sundstrand Corporation, Rockford, Ill.

[21] Appl. No.: 247,123

[22] Filed: Sep. 20, 1988

[51] Int. Cl.[6] ..... B63B 22/00; B63B 22/24

[52] U.S. Cl. ..... 441/7; 441/11

[58] Field of Search ..... 114/326, 327, 114/328, 329; 441/33, 23, 7, 6, 11, 21, 32

[56] References Cited

U.S. PATENT DOCUMENTS

| | | | |
|---|---|---|---|
| 1,734,864 | 11/1929 | Krause | 114/328 |
| 1,748,874 | 2/1930 | Fentress | 114/328 |
| 1,841,161 | 1/1932 | Stetler | 114/327 |
| 2,273,497 | 2/1942 | Rivera | 114/327 |
| 3,120,183 | 2/1964 | Wheelwright | 102/334 |
| 3,613,616 | 10/1971 | Basset | 441/23 |
| 3,704,678 | 12/1972 | Kelly | 114/160 |
| 4,006,732 | 2/1977 | Schumm | 126/271.1 |
| 4,430,552 | 2/1984 | Peterson | 441/33 |
| 4,598,552 | 7/1986 | Weber | 126/263 |
| 4,634,479 | 1/1987 | Buford | 149/6 |
| 4,671,211 | 6/1987 | Buford | 122/4 R |
| 4,714,051 | 12/1987 | Buford | 122/40 |

FOREIGN PATENT DOCUMENTS

| | | | |
|---|---|---|---|
| 663960 | 5/1963 | Canada | 441/33 |

*Primary Examiner*—Michael J. Carone
*Attorney, Agent, or Firm*—William D. Lanyi

[57] ABSTRACT

A signal buoy is provided which is ejectable from a submarine vehicle. The buoy is also provided with an internal heat source that raises the temperature of a portion of the buoy to a magnitude sufficient to melt ice. The buoy is provided with sufficient buoyancy to cause it to rise upward through the water above a submarine vehicle and, eventually, to make contact with the undersurface of a body of ice. The attitude of the buoy is maintained in such a way that the internally generated heat causes the ice to melt and, in cooperation with the buoyancy of the buoy, moves the buoy upward through a hole melted in the ice. The buoy is provided with a means for transmitting a signal to a land based or airborne receiving station. Either one way or two way communication are possible, with two way communications being provided by a signal line connecting the buoy with the submarine vehicle.

8 Claims, 5 Drawing Sheets

ICE PENETRATING COMMUNICATION BUOY

BACKGROUND OF THE INVENTION

1. Field of the Invention

The present invention is directed to a communication buoy and, more particularly, to a communication buoy which is capable of penetrating upward through a body of ice after being ejected from a submarine vehicle.

2. Description of the Related Art

Many different devices have been developed for the purpose of providing a means for communication between underwater vehicles and land based or airborne vehicles. Additionally, various devices have been developed to provide a means for melting ice.

U.S. Pat. No. 1,748,874, which issued to Fentress on Feb. 25, 1930, describes a signal device for use by sunken vessels which permits the crew of a sunken vessel to signal for help while also providing a means for marking the position of the sunken vessel. The signal device incorporates a cylinder that has an upper end opening out through the deck or another portion of a vessel. The upper end of the cylinder is closed by a hinged door that has a gasket that provides a water tight joint. A buoy is arranged in the cylinder and is provided with a centrally arranged bore which has an upper end that is reduced in size and a lower end that is terminated short of the lower end of the buoy.

U.S. Pat. No. 2,273,497, which issued to Rivera on Feb. 17, 1942, describes a signal pontoon for submarines for the purpose of providing a way to release the pontoon from a submarine if the submarine is sunken accidentally. Men in the pontoon can furnish air to others in the submarine and can communicate with the men in the submarine. Furthermore, the men in the pontoon are provided with the capability of communicating a distress signal for the purpose of securing help.

U.S. Pat. No. 3,704,678, which issued to Kelly on Dec. 5, 1972, describes a submarine tanker with a substantially rigid frame in longitudinal vertical sections. The frame is constituted of an inner cylindrical operative center carrying the bridge and crew deck quarters extending for and aft from the operations and bridge sections. Means are provided to open holes in pack ice above the vessel to permit floats to rise to the surface of the sea. In the event that the vessel must be abandoned, escape bells are carried by the vessel and are capable of functioning to effect the result even when the vessel is submerged under pack ice.

U.S. Pat. No. 1,734,864, which issued to Krause on Nov. 5, 1929, discloses a submarine safety device. The safety apparatus of this patent includes a marking buoy and communication buoy and a means for controlling the release of these buoys from the interior of the vessel. After the buoy has floated to the surface, it can be retrieved by a rescue ship and a cable that is attached to the buoy can be drawn upwardly to extend a normally collapsed hose. Following the extension of the normally collapsed hose, its sealing cap is removed and the crew of the submarine can be removed through the hose.

U.S. Pat. No. 4,006,732, which issued to Schumm on Feb. 8, 1977, discloses a means for melting ice for use in conjunction with ice fishing. This device uses a storage tank of flammable gas that is ignited in an annular containment that is disposed on the upper surface of a body of ice around a generally circular opening extending through the ice to the water below. This device is adapted for use in relation to a hole in a layer of ice for the purpose of maintaining the hole free of ice so that ice fishing can continue without the inconvenience of having the water in the fishing hole freeze.

U.S. Pat. No. 3,120,183, which issued to Wheelwright et al on Feb. 4, 1964, discloses a pyrotechnic apparatus that is a smoke generating pyrotechnic device which is capable of generating smoke in a cold atmosphere or when floating in water as when the device is used as a marine distress signal. The pyrotechnic device described in this patent employs a heat resistant low thermal conductivity material for its body. This material can be a resin bonded paper and is intended to improve the performance of the pyrotechnic device by giving an increased volume of smoke and by reducing the risk that combustion is extinguished before the entire composition is burned.

U.S. Pat. No. 4,671,211, which issued to Buford on Jun. 9, 1987, discloses a power source that utilizes encapsulated lithium pellets and discloses a method for manufacturing such encapsulated lithium pellets. This patent describes a heat exchanger for a thermal power source that includes a chamber provided with an igniter and a reactant inlet. Within the chamber is a mass of lithium pellets with each lithium pellet being provided with a coating. The technique described in this patent is particularly suitable for use in the subject invention. In an exemplary embodiment of the power source described in the Buford patent, a heat exchanger includes a heat exchanging housing with a closeable chamber. An ignition device is disposed within the chamber and the chamber is also provided with a reactant inlet. Within the chamber is a mass of lithium pellets which are coated in situ with the predominately fluorine substituted hydrocarbon material described in detail in the Buford specification.

U.S. Pat. No. 4,714,051, which issued to Buford on Dec. 22, 1987, describes a power source utilizing encapsulated lithium pellets and a method of making such pellets. It provides a power or heat source in which lithium pellets are encapsulated in a predominately fluorine substituted polymeric material and oxidized to provide heat.

U.S. Pat. No. 4,634,479, which issued to Buford on Jan. 6, 1987, also describes a power source that utilizes encapsulated lithium pellets. The encapsulated lithium includes a shot shaped and sized body of lithium metal encapsulated in a thin layer of a predominately fluorine substituted polyolefin based polymeric material.

U.S. Pat. No. 4,598,552, which issued to Weber on Jul. 8, 1986, discloses an energy source for a closed cycle engine which includes a boiler having a working fluid chamber in heat exchange relation with a reaction chamber. A closed flow path loop including a turbine receives working fluid from the fluid chamber, provides a power output and returns the fluid to the chamber. Lithium is reacted with water in the reaction chamber to generate heat for heating the working fluid and hydrogen. Oxygen, obtained by decomposition of sodium superoxide elsewhere in the system is fed to the reaction chamber and combined with the hydrogen to provide water and additional heat for the working fluid.

U.S. Pat. Nos. 4,671,211; 4,714,051 and 4,634,479 are hereby specifically incorporated by reference.

SUMMARY OF THE INVENTION

When submarine vehicles are used under large bodies of ice, some means must be provided to permit the submarine vehicle to communicate with either land based or airborne communication facilities. This requirement for communication may result from the need to respond to a command received from a land based communication station or, in some cases, may arise from the fact that the submarine vehicle is disabled and is in need of assistance.

When a submarine vehicle requires a means to communicate with a land based or airborne communication station, it is sometimes possible for the submarine vehicle to penetrate the body of ice with the submarine vehicle itself by rising upward, against the undersurface of the body of ice, and forcing the vehicle upward through the ice floe. This technique presents several difficulties. First, the thickness of the ice may make this technique undesirable because of the potential damage that can be incurred by the submarine vehicle during this procedure of breaking through the ice. Furthermore, by exposing the submarine vehicle in this manner, the submarine vehicle exposes itself to detection by unfriendly aircraft and, during a period of hostilities, this exposure could result in an attack on the submarine vehicle by unfriendly forces. For the reasons described above, it would be significantly beneficial if some means were provided to permit the submarine vehicle to communicate with land based or airborne communication stations by disposing a transmitter at or above the upper surface of the ice floe without the necessity of exposing the submarine vehicle itself through an opening in the ice. By disposing a transmitting means at or above the surface of the ice while the submarine vehicle remains submerged, signals can be transmitted to land based or airborne communication stations without the inherent interference that would otherwise be experienced if such communication were attempted from a transmitter located below the ice floe. If the transmitting means is disposable at or above the surface of the ice in a manner which permits the submarine vehicle to remain submerged at a remote position relative to the transmitting means, signals could be transmitted to receiving stations without the need for exposing the submarine vehicle itself to potential detection or attack by hostile forces.

The subject invention provides a signal buoy that is capable of rising upward through water after being ejected by the submarine vehicle. Furthermore, a preferred embodiment of the subject invention is provided with a means for increasing its buoyancy after ejection to cause it to rise from the submarine vehicle upward toward the undersurface of the ice located above the submarine vehicle. Additionally, the subject invention provides a heat source which provides the capability for the communication buoy to progressively melt the ice and rise upward through an opening created by the melting of the ice. The buoyancy of the communication buoy and the source of heat permit the communication buoy to travel upward through a hole formed as ice is melted by the leading end, or nose, of the buoy. After the communication buoy of the subject invention rises upward through the hole in the ice and, eventually, protrudes through the upper surface of the ice, a communication signal can be effectively transmitted from the buoy to land based or airborne receiving stations.

In alternative embodiments of the subject invention, the communication buoy can be provided with either a prerecorded message to be transmitted, by means of one way communication, to a receiving station or, alternatively, the buoy can be connected in continued signal communication with the submarine for purposes of permitting two way communication between the submarine vehicle and a land based or airborne communication station. The characteristics of the subject invention therefore permit either one way or two way communication, depending on the preferred embodiment employed.

Structurally, a preferred embodiment of the subject invention incorporates a containment shell that is generally impermeable to water and, within the containment shell, a means for increasing the buoyancy of the signal buoy comprising the containment shell. Additionally, the present invention comprises a means for providing a source of heat within the containment shell and a means for transmitting a signal from the signal buoy.

In a preferred embodiment of the present invention, a means is provided for maintaining the buoy in a predetermined attitude relative to a generally stationary body, such as an ice floe. This maintaining means comprises a plurality of extendable legs which, when extended, provide a stable support in contact with the undersurface of a body of ice for the purpose of maintaining the signal buoy in a predetermined attitude relative to the undersurface of the ice.

The containment shell of the present invention, in a preferred embodiment, comprises two generally cylindrical members associated in concentric relation with each other in such a way that the two cylindrical members are slidable relative to each other. In response to an increase of pressure within the signal buoy containment shell, the two slidable cylindrical members are caused to slide with respect to each other in a way which extends the effective length of the signal buoy and, as a result, increases the volume of the buoy while decreasing its density. This decrease in density results in an increase of the buoyancy of the signal buoy and causes the buoy to rise upward through water toward the undersurface of a body of ice.

A source of heat, such as a boiler, is disposed in thermal communication with a pool of liquid, such as water, within the containment shell in such a way that the liquid is boiled and the resulting steam is directed toward a preselected portion of the containment shell. If the steam is directed towards the upper end of the buoy as it moves into contact with the undersurface of a body of ice, the upper end, or nose, of the buoy will provide sufficient heat to melt the ice which is in contact with the nose portion of the buoy. This thermal communication between the leading end of the signal buoy and the ice will progressively create a hole through the ice as the buoy moves upward against the undersurface of the ice and, eventually, upward through the hole created by the melting process. As the signal buoy continues to melt its way through the body of ice, it will eventually create a generally cylindrical hole through the entire thickness of the ice and protrude upward through the upper surface of the ice. When this occurs, the nose of the buoy will be positioned advantageously for transmission of signals to land based or airborne receiving stations.

When the nose of the signal buoy protrudes through the upper surface of the ice, means is provided to extend an antenna upward from the containment shell. This antenna is connected in signal communication with a transmitting means contained within the signal buoy. Once the signal buoy is positioned in the manner described above, with an antenna extending upward above the upper surface of the ice, the buoy can be operated as either a one way or two way communication device. During the one way mode of operation, a prerecorded message or signal can be transmitted from the signal buoy so that a receiving station can receive the signal and, if necessary, determine the position of the buoy. During the two way mode of operation, a signal line, or wire, is provided to connect the signal buoy to the submarine vehicle from which it was ejected. This connection permits the submarine vehicle to both receive and transmit signals between the submarine vehicle and a land based or airborne communication station.

Although the present invention provides a means for increasing the buoyancy of the signal buoy after it is ejected from the submarine vehicle, it should be understood that a constant buoyancy buoy could alternatively be employed within the scope of the subject invention. However, in a preferred embodiment of the subject invention, it is advantageous to minimize the physical size of the signal buoy before the time when it is ejected from the submarine vehicle. For this reason, two or more slidable cylinders are stored in a collapsed position and, after ejection from the submarine vehicle, the increased pressure within the containment shell of the signal buoy caused by the creation of steam within the containment shell causes the cylindrical members to slide relative to each other in such a way that the effective length and volume of the signal buoy are increased with a resulting increase in its buoyancy. In a preferred embodiment of the subject invention, it has been found advantageous to dispose the relatively heavy components, such as the transmitter, at the end of the buoy opposite to the leading end, or nose. This locates the center of gravity of the buoy more proximate the tail of the buoy so that the buoy rises through the water with its nose, or leading end, disposed in an upward direction as the buoy travels from the submarine vehicle toward the undersurface of the body of ice. This provides an advantage in that the leading end, or nose, of the buoy makes initial contact with the underside of the body of ice and, since the nose of the buoy is the portion of the containment shell that is most directly exposed to the steam resulting from the heat source and the pool of liquid, the disposal of the denser components at the opposite, or tail, end of the buoy positions the present invention in an advantageous attitude for the purposes of performing its intended functions.

In a preferred embodiment of the subject invention, the heat source comprises a chamber disposed within the containment shell that is suitable for containing an exothermic chemical reaction. This exothermic chemical reaction, in a preferred embodiment of the present invention, comprises a reaction between lithium and fluorine in a manner such as that described in U.S. Pat. No. 4,671,211 discussed above. The heat source chamber is disposed within the containment shell in such a way that it is in thermal communication with a pool of liquid so that heat emanating from the chamber can boil the liquid and produce steam which is directed toward the nose of the buoy through a steam riser pipe. According to a preferred embodiment of the subject invention, the steam riser pipe directs steam toward the nose of the buoy and results in the nose and adjacent portions of the containment shell being at the highest temperature of the overall signal buoy containment shell.

It is therefore an object of the present invention to provide a means for communicating between a submarine vehicle and a land based or airborne receiving station while the submarine vehicle is submerged beneath a body of ice. It is a further object of the present invention to provide a signal buoy that is capable of rising upward through water after ejection from a submarine vehicle and, after making initial contact with the undersurface of a body of ice, melting through the ice in an upward direction to eventually penetrate the upper body of ice and protrude above the upper surface of the ice. It is a still further object of the present invention to provide a signal buoy with heat generating capability for melting through a body of ice and, after protruding through the upper surface of the body of ice, for causing an antenna to extend through an opening in the shell of the signal buoy for purposes of facilitating transmission from a transmitter located within the containment shell of the signal buoy.

DESCRIPTION OF THE DRAWING

The present invention will be more fully understood from a reading of the description of the preferred embodiment in conjunction with the drawing, in which.

DESCRIPTION OF THE PREFERRED EMBODIMENT

Figure 1:
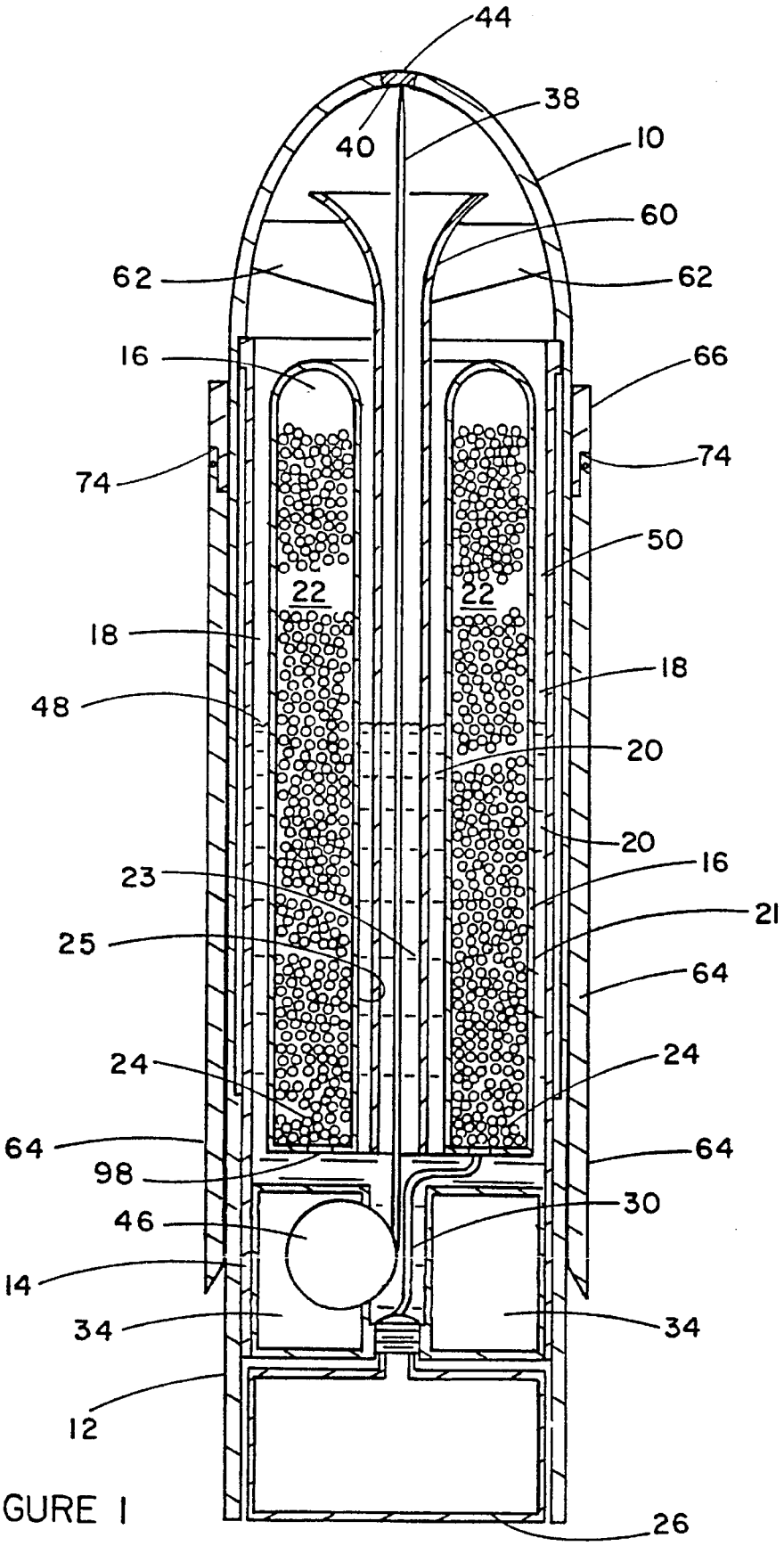
FIG. 1 shows cross-section view of the subject invention in a pre-ejection configuration.

The present invention is shown in FIG. 1 in a collapsed, or pre-ejection, configuration. The containment shell 10 of the present invention comprises a first generally cylindrical member 12 and a second generally cylindrical member 14. These two cylindrical members, or portions, are arranged in coaxial relation with each other and are initially disposed concentric to each other. The first 12 and second 14 cylindrical members are slidable with respect to each other as will be described in greater detail below. Although the present invention is described herein as comprising two cylindrical members, it should be understood that it is not so limited. Alternatively, three or more cylindrical members could be used in alternative embodiments of the present invention.

Within the containment shell 10, a heat source 16 is disposed in such a way that it forms a space 18 between the heat source 16 and the inner surface of the containment shell 10. This generally annular space 18 is shaped to receive and contain a preselected quantity of a liquid 20, such as water. As can be seen in FIG. 1, the liquid 20 is disposed in thermal communication with the outer surface 21 of the heat source 16. In a preferred embodiment of the present invention, the heat source 16 is formed in an annular shape and, as a result, also provides a second space 23 proximate its centerline. This second space 23 is defined by the inner surface 25 of the heat source 16 and, as a result, the liquid 20 is also in thermal communication with the inner surface 25. Therefore, heat produced by the heat source 16 can be communicated from the heat source 16 to the liquid 20 through both its outer surface 21 and inner surface 25.

In a preferred embodiment of the present invention, the heat source 16 comprises a chamber 22 that is suitable for containing a preselected mixture of chemicals. As shown in FIG. 1, both the heat source 16 and its chamber 22 are generally annular in shape and the chamber 16 is filled with a quantity of chemicals 24 such as a plurality of lithium pellets coated with a predominately fluorine substituted hydrocarbon, as described in U.S. Pat. No. 4,671,211 which is hereby explicitly incorporated by reference. Although these particular chemicals are used in a preferred embodiment of the present invention, it should be understood that if alternative combinations of chemicals are developed which can satisfactorily provide exothermic reactions of this type, they too would be suitable for use in conjunction with the present invention and should be considered within its scope. The heat source 16 is disposed proximate the liquid 20 in such a way that heat emanating from the chamber 22 of the heat source 16 will cause the liquid 20 to boil and provide a source of relatively hot vapor, such as steam. In a preferred embodiment of the present invention, the liquid 20 is water. However, it should be understood that alternative liquids can also be used in alternative embodiments of the present invention.

An oxidant vessel 26 is provided as part of the signal buoy of the present invention. The oxidant vessel 26 is connected in fluid communication with the chamber 22 of the heat source 16 for the purpose of supporting the chemical reaction within the chamber 22, as described in detail in U.S. Pat. No. 4,671,211. It should be noted that, as illustrated in FIG. 1, the oxidant vessel 26 is configured in such a way that it can remain disconnected and separated from the remaining portion of the buoy until immediately before the time when the buoy is to be deployed. Prior to preparation of the buoy for ejection, the oxidant vessel 26 can be connected to the buoy by a threaded connection, as illustrated in FIG. 1. The separate storage of the buoy and the oxidant vessel 26 provides a beneficial safety characteristic of the present invention. The fluid communication between the oxidant vessel 26 and the chamber 22 of the heat source 16, after these components are connected as shown, is provided by a conduit 30 as illustrated in FIG. 1. In a preferred embodiment of the present invention, the oxidant vessel 26 contains a quantity of sulfur hexafluoride.

The present invention also comprises a transmitter 34, shown schematically in FIG. 1, which is connected in signal communication with an antenna 38. The antenna 38 is contained within the containment shell 10 and is extendable through an opening 40 in the nose of the buoy. The opening 40 is provided with a cover 44 that is suitable to prevent water from flowing through the opening 40 and into the containment shell 10. The cover 44 is removable to permit the antenna 38 to be extended through the shell (i.e. in an upward direction in FIG. 1). Although various types of removable coverings 44 are suitable within the scope of the present invention, one particular covering 44 comprises a meltable solder compound that melts at an empirically determined temperature. When the cover 44 is removed from the opening 40, the antenna 38 can be extended through the containment shell 10 in response to a spring force provided by a spring mechanism 46 shown schematically in FIG. 1. It should be understood that many known types of transmitter 34 and antenna 38 can be used in accordance with the present invention and, furthermore, that various alternative types of known spring mechanisms 46 and covers 44 can also be used in conjunction with the present invention. Since the present invention is intended primarily as a delivery vehicle which can position a transmitter and antenna at a location appropriate for transmitting and/or receiving signals from a land based or airborne communication station, the specific types of transmitter 34 or antenna 38 does not directly effect the operation of the present invention. Similarly, the specific type of spring mechanism and cover used in conjunction with the present invention is not limited, except functionally, and can be any type of device which performs its intended function.

As described above, spaces 18 and 23 between the heat source 16 and the inner surface of the containment shell 10 are shaped to receive a quantity of liquid 20, such as water. As indicated by the upper surface 48, a portion 50 of the space 18 is ullage and is not filled with liquid. As the heat from the heat source 16 raises the temperature of the liquid 20 to its boiling point, vapor emanating from the boiling liquid 20 will rise into the space 50 above the surface 48 of the liquid. As this steam rises from the boiling liquid 20, pressure within the containment shell 10 will be increased. In response to the increase of pressure within the containment shell 10, the first generally cylindrical member 12, or portion, will begin to slide with respect to the second generally cylindrical member 14, or portion, and, as a result, the effective length of the buoy will be increased. This increase in the effective length of the buoy will correspondingly increase the effective volume of the containment shell 10 and, in turn, will increase the buoyancy of the buoy. This increase in buoyancy will further induce the buoy to rise upward through the water after ejection from a submarine vehicle and initiation of the exothermic chemical reaction within the chamber 22. As will be discussed in greater detail below, the exothermic chemical reaction within the chamber 22 is initiated by an initiator 98 which can be any suitable heat source that is capable of raising the temperature of the encapsulated lithium pellets in its immediate vicinity to the temperature at which an oxidation reaction between the lithium and the polymeric coating occurs. For purposes of safety, the initiation of this reaction is preferably delayed until the buoy has completely been ejected from the submarine vehicle. Various known techniques can be employed to provide this delayed initiation of the reaction until the buoy has been completely ejected. For example, a lanyard can be provided which is connected to some portion of the submarine vehicle and which is also connected to a suitable triggering device which causes the initiator 98 to be activated when the lanyard is extended to its full length. Although not illustrated in FIG. 1, the concept of using a lanyard for these purposes would consist of attaching one end of the lanyard to a portion of the buoy and the other end of the lanyard to a portion of the submarine vehicle. After the buoy has been ejected and has moved a reasonable distance away from the submarine vehicle, the lanyard would be extended to its full length and the resulting force on the associated portion of the buoy would trigger the operation of the initiator 98. It should be understood that various other techniques can be employed to accomplish the goal of delaying the initiation of the chemical reaction until the buoy is safely away from the submarine vehicle.

Figure 2:
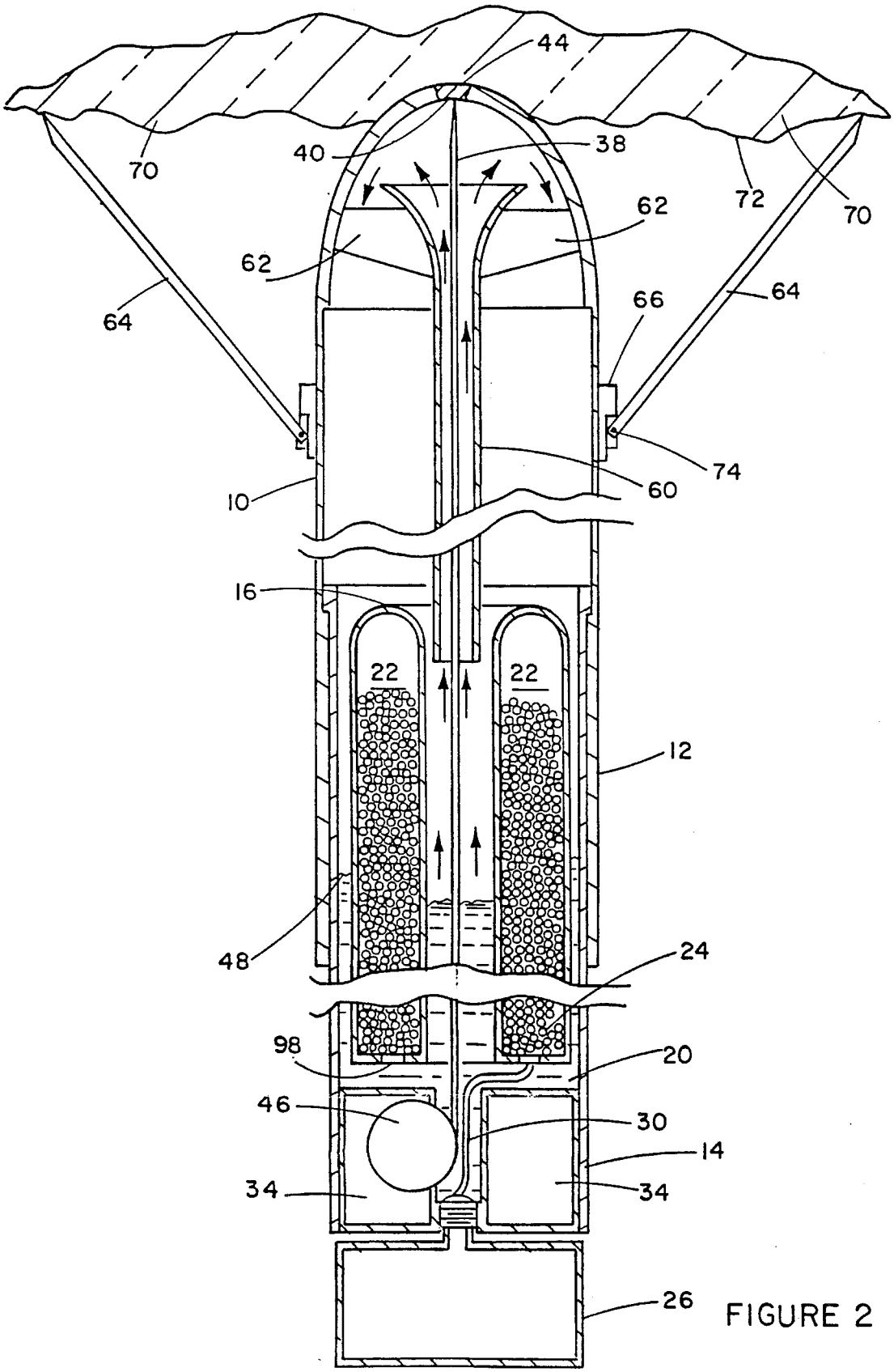
FIG. 2 shows the subject invention in a post-ejection configuration with its cylindrical members extended relative to each other and its extendable legs in an extended position.

The signal buoy of the present invention is also provided with a generally tubular steam riser 60 which operates to direct steam upward, as shown in FIG. 2, from the central space 23 within the annular-shaped heat source 16. Therefore, the riser 60 will direct steam toward the nose of the signal buoy shown at the upper portion of FIG. 1. As also shown in FIG. 1, the riser 60 is connected to the inner surface of the first generally cylindrical member 12 by supporting ribs 62. Therefore, as the first and second cylindrical members slide relative to each other and extend the effective length of the signal buoy, the riser 60 will move with the first cylindrical member 12, or portion, of the buoy. The length of the riser 60 is selected to provide a conduit for steam rising from the pool of liquid 20 that is boiling within the central opening of the annular heat source 16. The bottom portion of the riser 60 is eventually pulled upward relative to the heat source 16 until it is proximate the upper portion of the heat source 16. Even at this extended position, the riser 60 is properly disposed to direct steam from the pool of liquid 20 toward the nose of the buoy.

Also shown in FIG. 1 is a plurality of extendable legs 64 that are shown in a collapsed configuration. The extendable legs 64 are pivotally attached to a collar 66 that is disposed around the periphery of the first generally cylindrical member 12. In a preferred embodiment of the present invention, the extendable legs 64 are spring loaded in such a way that they will tend to pivot about their pivot point 74, which is connected to the collar 66, and extend away from the outer cylindrical surface of the first generally cylindrical member 12. Although not specifically illustrated in the figures, it should be understood that some type of spring mechanism is employed to cause the legs 64 to rotate about the pivot point 74 and away from the containment shell 10. Many different types of suitable spring mechanisms are known to those skilled in the art of mechanical design. Therefore, after ejection from the submarine vehicle, the legs will tend to swing, in an upward direction in FIG. 1, about their pivot points 74 by which they are connected to the collar 66. The operation of the extendable legs 64 will be described in greater detail below. One particular, and preferred, embodiment of the present invention incorporates a collar 66 which is not rigidly attached to the outer surface of the first generally cylindrical member 12. Instead, the collar 66 can be slidably associated with the outer surface of the first generally cylindrical member 12 in such a way that it can move along the outer surface of the buoy from its position shown in FIG. 1 toward a position farther from the nose and closer to the tail end of the buoy where the transmitter 34 and oxidant vessel 26 are located. Some type of mechanism, as will be discussed in greater detail below, is employed to maintain the position of the collar 66 with respect to the first generally cylindrical member 12 until the legs are permitted to swing outwardly from the containment shell in response to the spring mechanism.

As can also be seen in FIG. 1, the relatively dense components of the present invention are disposed at the tail end of the buoy at the bottom portion of FIG. 1. These relatively heavy components comprise the transmitter 34, the spring mechanism 46 and the oxidant vessel 26. Since these components are relatively heavier than the components located more proximate the nose of the buoy, the signal buoy of the present invention will tend to rise through the water with the nose in an upward position and the tail in a downward position after it is ejected from the submarine vehicle. This attitude of the buoy during its rise from the submarine vehicle is advantageous because of the fact that the nose of the buoy is maintained at a higher temperature than the remaining portions of the buoy. Therefore, if the nose of the buoy is caused to rise upward during the travel of the buoy from the submarine toward the undersurface of a body of ice, the hotter portion of the buoy's containment shell (i.e. the nose) will make initial contact with the undersurface of the ice floe and will begin to direct the hottest portion of the buoy's containment shell through the ice as the nose causes the ice to melt.

FIG. 2 illustrates the present invention in an expanded configuration. As heat from the exothermic reaction within the chamber 22 of the heat source 16 causes the liquid 20 to boil, the first 12 and second 14 cylindrical members, or portions, are caused to slide relative to each other and expand the effective length and volume of the containment shell 10. This expanded volume of the buoy, in conjunction with the disposition of the denser components proximate the tail of the buoy, causes the buoy to rise upward through the water toward a body of ice 70 and, more particularly, toward the undersurface 72 of the body of ice 70. FIG. 2 illustrates the position of the buoy after it has made initial contact with the undersurface 72 of the body of ice 70 and the extendable legs 64 are caused to rotate about their pivot points 74 which provide the contact between the extendable legs 64 and the collar 66. Therefore, it should be understood that the extendable legs 64 provide a base of contact between the buoy and the undersurface 72 of the body of ice 70. The extendable legs 64, in cooperation with the denser components at the tail of the buoy maintain the attitude of the buoy as shown in FIG. 2 as the buoy begins to melt its way upward through the body of ice 70.

As the exothermic reaction within the chamber 22 of the heat source 16 causes the liquid 20 to boil, the steam riser 60 directs a portion of the steam upward through the riser 60 toward the nose of the buoy. The direction of the steam as it passes upward through the riser 60 is indicated by the arrows in FIG. 2. It is recognized that a portion of the steam will rise directly from the surface 48 of the liquid 20 along the inner surface of the containment shell 10 and, therefore, bypass the preferred direction of steam flow upward through the riser 60. However, a portion of the steam will be directed upward through the riser 60 as indicated by the arrows in FIG. 2. It should be understood that the level of the liquid 20 in the central portion of the heat source 16 (i.e. within space 23) will be slightly lower than the surface of the liquid 20 located in the radially outward region of the liquid pool (i.e. within space 18). This slight discrepancy in liquid levels is caused by the increased pressure created by the boiling liquid as the steam is directed upwardly from the liquid located in the inner space 23. While not a specific requirement of the present invention, this slight discrepancy in fluid levels is expected during operation of the communication buoy.

Although not shown in detail in FIG. 2, it should be understood that some means must be provided to prevent the second generally cylindrical member 14 from sliding completely away from contact with the first generally cylindrical member 12. The disconnection of these two cylindrical members can be prevented by some relatively simple means such as a lip formed in the ends of the cylindrical members or any similar structure to prevent a complete disconnection between the first and second cylindrical members of the containment shell 10. One specific embodiment of the present invention that can be used to provide this function will be described in greater detail below in conjunction with FIG. 5.

As shown in FIG. 2, the buoy has begun to melt through the undersurface 72 of the body of ice 70 and the nose the buoy has begun to penetrate into the body of ice 70. The cover 44 over the opening 40 remains in place and the antenna 38 remains retracted and contained entirely within the containment shell 10. Steam rising upward through the riser 60 flows into contact and thermal communication with the inner surface of the nose portion of the buoy, thereby transferring heat through the nose portion of the buoy and into the body of ice 70. This transfer of heat from the buoy to the ice causes the ice to melt and permits the nose of the buoy to penetrate through the undersurface 72 of the body of ice 70. The containment shell 10 and, more particularly, the first cylindrical member 12 is made of a material that is thermally conductive. The thermal conductivity of this material permits heat to be transferred from the steam, through the thickness of the nose portion of the first cylindrical member 12, to the ice.

Figure 3:
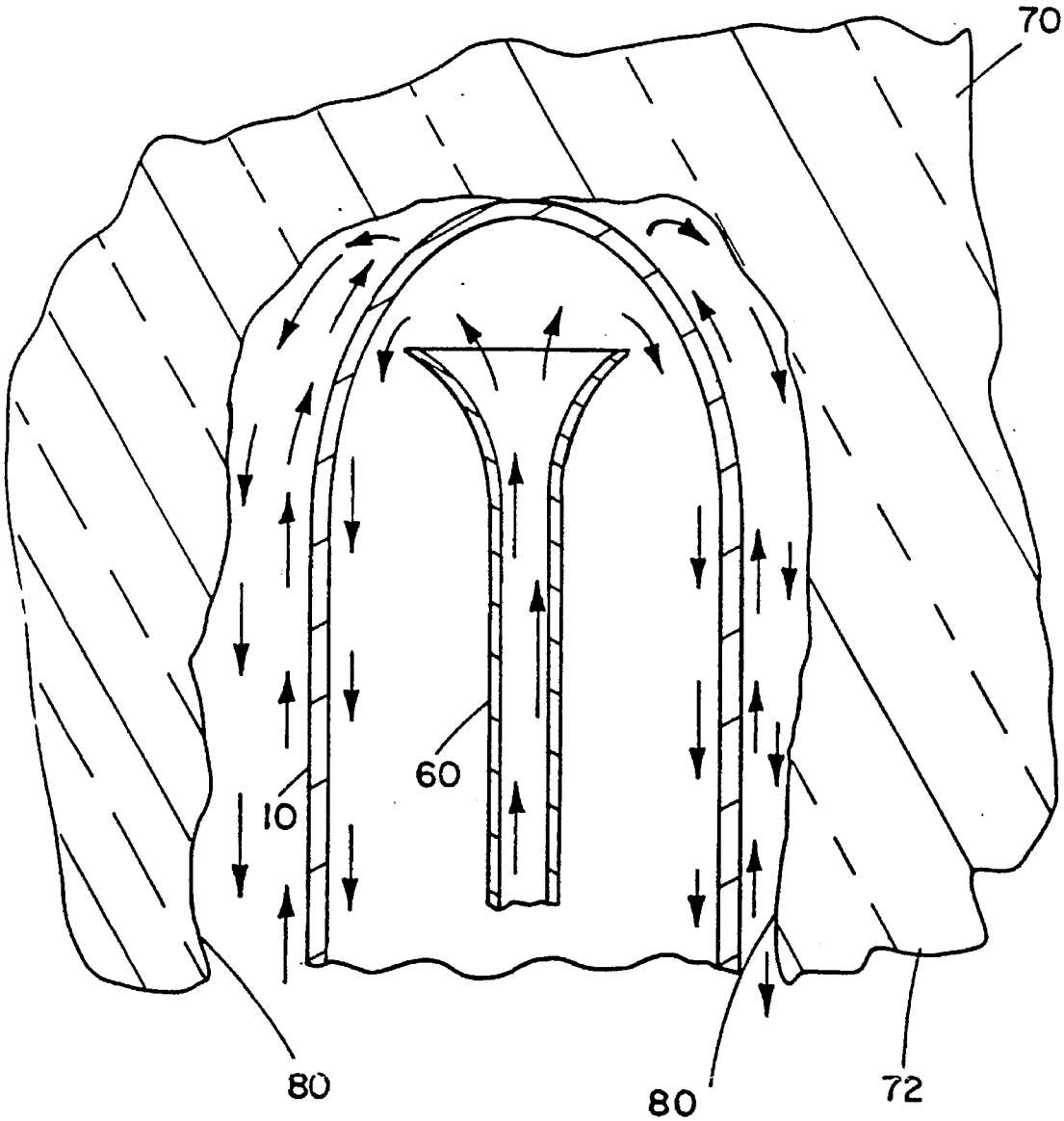
FIG. 3 shows the operation of the steam riser in conjunction with the ice melting process induced by the present invention.

FIG. 3 is a schematic representation of the action of the buoy as it penetrate the body of ice 70. For purposes of this description, the buoy is shown schematically with only a portion of the riser 60 illustrated within the buoy. Therefore, only the relevant portions of the buoy that are necessary for this discussion are illustrated in FIG. 3. Inside the containment shell 10, steam rises upward through the riser 60 and is directed toward the inner surface of the nose portion of the buoy. As indicated by the arrows within the riser 60, the steam rises and, as it exits from the upper opening of the riser 60, flows into thermal communication with the inside surface of the nose portion. As the steam flows into thermal communication with the nose portion of the containment shell 10, it transfers heat to the containment shell 10, which is at a lower temperature than the steam, and raises the temperature of the nose portion of the shell. This transfer of heat from the steam to the containment shell 10 lowers the temperature of the steam and condenses it. The resulting condensate flows along the inner surface of the nose portion of the buoy and downward along the inner surface of the containment shell 10, as indicated by the arrows within the containment shell 10, and along the inner surface of its wall. The condensate continues to flow downward along the inner wall of the containment shell 10 and, eventually, back through the space 18 to the outer annular pool of liquid 20 (not shown in FIG. 3). As condensate continues to flow into the outer annulus of liquid 20, it eventually flows into the inner annulus 23 where its temperature is raised by the thermal communication with the heat source 16. As a result of this thermal communication with the heat source 16, the temperature of the liquid in the inner annulus 23 is raised to its boiling point and again flows, as a vapor, upward through the riser 60 to continue the heat transfer process described above. This transfer of heat from the steam to the shell raises the temperature of the shell above the temperature of the ice 70 and causes the ice, which is most proximate and in contact with the nose of the buoy, to melt.

It must also be realized that, because of the presence of the heat source and resulting steam inside the containment shell 10, the containment shell is at a higher temperature than the surrounding liquid water immediately proximate the outer surface of the buoy. This causes water, located between the outer surface of the buoy and the inner surface 80 of the hole in the ice, to move along the paths indicated by the arrows in FIG. 3. The water that is most proximate the outer surface of the buoy will tend to be heated because of its proximity to the outer surface of the containment shell 10 and, as a result, rise in an upward direction in the hole. This warmed water will rise upward along the outer surface of the buoy until it reaches the region where the nose of the buoy is in contact with the ice. At this point, the warmed water in the hole will transfer heat to the ice and, as a result, be cooled and caused to flow downward along the outer surface 80 of the hole. This convective heat transfer combines with the conductive heat transfer, directly between the buoy and the ice, to melt the hole through the ice.

As the convective heat transfer shown in FIG. 3 occurs, the buoy will continue to melt a hole upward through the body of ice 70. Because of the heat transferred from the buoy to the water in the hole and the resulting currents between the outer surface of the buoy and the inner surface 80 of the hole, the diameter of the hole will tend to be somewhat larger than the outer diameter of the buoy. This result is caused by the direct conductive transfer of heat from the nose tip of the buoy to the ice and the indirect convective transfer of heat from the buoy to the water rising upward along the outer surface of the buoy to the ice and, in turn, to the inner surface 80 of the hole in the ice. It should also be understood that the buoyancy of the signal buoy is simultaneously providing an upward force that pushes the buoy's nose against the ice as the buoy penetrates the body of ice 70. This force assists the process shown in FIG. 3 by causing the buoy to continually press against the ice, as it moves upward through the hole, and maintain good contact for thermal communication between the nose and the ice.

Figure 4A:
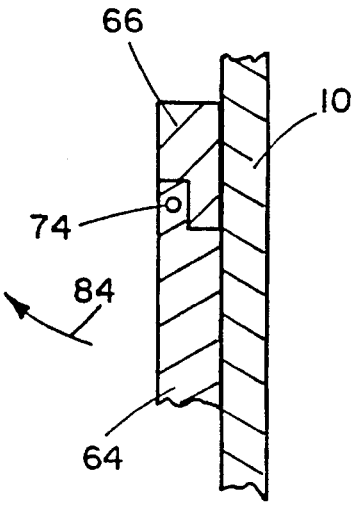
FIGS. 4A and 4B show alternative configurations of the extendable legs of the present invention.
Figure 4B:
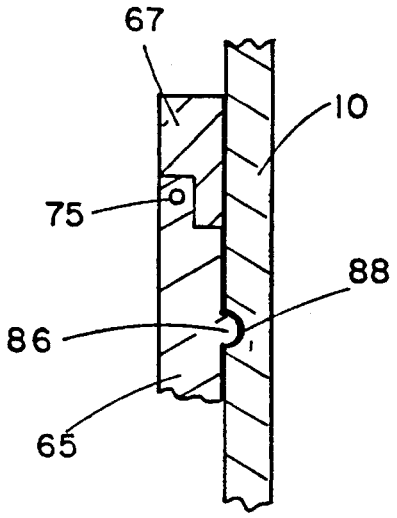

FIGS. 4A and 4B illustrate two alternative concepts that can be utilized in providing the extendable legs 64. FIG. 4A illustrates the alternative concept of using a collar 66 that is rigidly attached to the containment shell 10. As the extendable leg 64 rotate about pivot point 74, in the direction indicated by arrow 84, the collar 66 remains fixed with respect to its original position on the containment shell 10.

FIG. 4B shows a preferred embodiment of the extendable leg portion of the present invention. The differences of the embodiment shown in FIG. 4B will be described in comparison to the embodiment shown in FIG. 4A. Instead of a collar 66 that is rigidly attached to the containment shell 10, the embodiment shown in FIG. 4B utilizes a collar 67 that is capable of sliding along the outer surface of the containment shell 10. The collar 67 is provided with a pivot point 75 that is functionally similar to the pivot point 74 shown in FIG. 4A. Also, the extendable leg 65 shown in FIG. 4B is functionally similar to the extendable leg 64 shown in FIG. 4A, but is provided with some means to prevent the extendable leg 65 and collar 67 from moving relative to the containment shell 10 when the extendable leg 65 is disposed in its collapsed position along the containment shell 10 as shown in FIG. 4B. To prevent relative motion between the collar 67 and extendable leg 65 relative to the containment shell 10, a discontinuity 86 is shaped to be received in a depression 88 that is formed in the containment shell 10. Therefore, when the extendable leg 65 is disposed in a collapsed position proximate the containment shell 10, the discontinuity 86 cooperates with the depression 88 to prevent the assembly of the leg 65 and collar 67 from moving relative to the containment shell 10. It should be understood that, although the discontinuity 86 and depression 88 are specifically shown in FIG. 4B as a means for preventing this relative motion, other means for preventing motion between the leg 65 and collar 67 relative to the shell 10 could be used within the scope of the present invention. Any similar technique that prevents the collar 67 from sliding relative to the containment shell 10 when the leg 65 is in the collapsed position shown in FIG. 4B is suitable for use with the present invention.

FIGS. 4A and 4B illustrate two embodiments of the present invention that utilize two different techniques to provide the extendable legs and collar of the present invention. These two embodiments relate to two different techniques that are both applicable for use in conjunction with the present invention, depending on the particular type of operation desired. The concept shown in FIG. 4B is the preferred embodiment of the present invention. The operation of the present invention which relates to the results achieved by using the embodiment shown in FIG. 4B will be described below in conjunction with FIG. 6.

Figure 5:
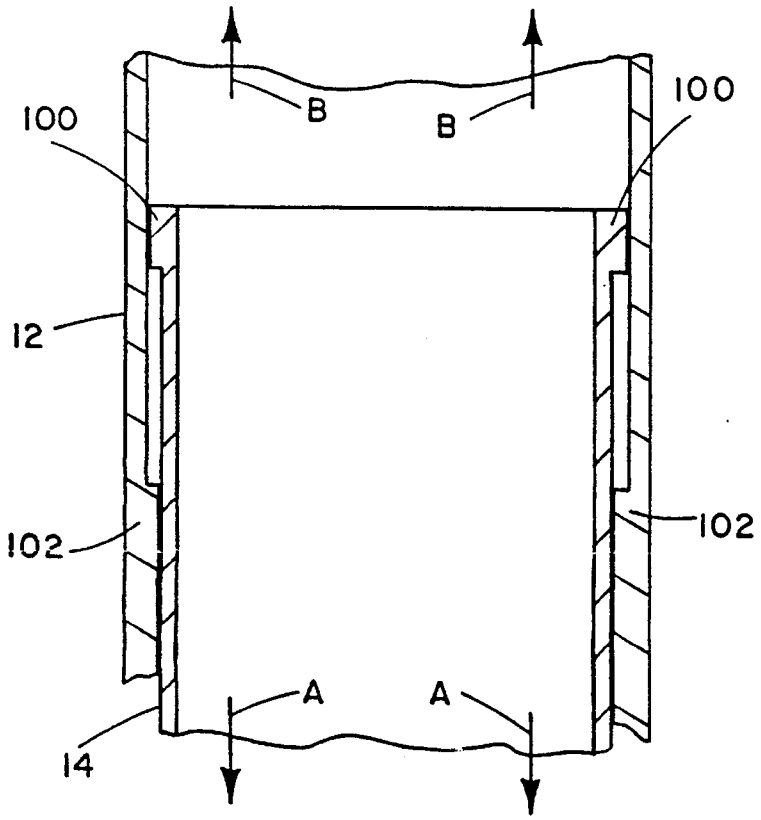
FIG. 5 illustrates a means for connecting the generally cylindrical members of the present invention in such a way that they are slidable with respect to each other.

FIG. 5 illustrates a possible technique, referred to briefly above, which can be utilized to permit the first cylindrical member 12 and the second cylindrical member 14 to be slidably associated with each other while preventing the two cylindrical members from separating completely in response to the increase in pressure within the buoy. For purposes of clarity, FIG. 5 illustrates only the first and second cylindrical members without the internal components of the buoy being shown. The first cylindrical member 12 is provided with a lip 102 which extends in a radially inward direction as shown. The inner cylindrical surface of the lip 102 is shaped to receive the outer cylindrical surface of the second cylindrical member 14 in sliding relation. A small radial clearance between the outer surface of the second cylindrical member 14 and the inner cylindrical surface of the lip 102 is provided to permit these two members to slide relative to each other.

Similarly, the second cylindrical member 14 is provided with a lip 100 which is an extension, in a radially outward direction, of the second cylindrical member. As can be seen in FIG. 5, the lip 100 of the second cylindrical member is disposed at its upper end and the lip 102 of the first cylindrical member is disposed at its lower end. As described above, the first cylindrical member 12 and the second cylindrical member 14 are caused to move axially with respect to one another in response to the increase in pressure within the buoy caused by the creation of steam. This relative movement is illustrated in FIG. 5 by arrows A and B. Arrows A indicate the relative downward movement of the second cylindrical member 14 and arrows B indicate the relative upward movement of the first cylindrical member 12. As these two members continue to move in the directions indicated by the arrows, lips 100 and 102 will gradually move toward each other as the buoy extends its effective length. Eventually, lips 100 and 102 will move into contact with each other and provide an interference which prevents further relative axial movement between the first cylindrical member and the second cylindrical member 14. Therefore, the lips 100 and 102 prevent complete separation of the cylindrical members and define its maximum axial length. As described above, the concept illustrated in FIG. 5 represents only one of numerous designs which perform the intended function of permitting the generally cylindrical members to move axially with respect to each other and extend the effective length of the buoy while preventing a complete disassociation of these members. It should therefore be understood that various alternative embodiments of the concept illustrated in FIG. 5 should be considered within the scope of the present invention.

Figure 6:
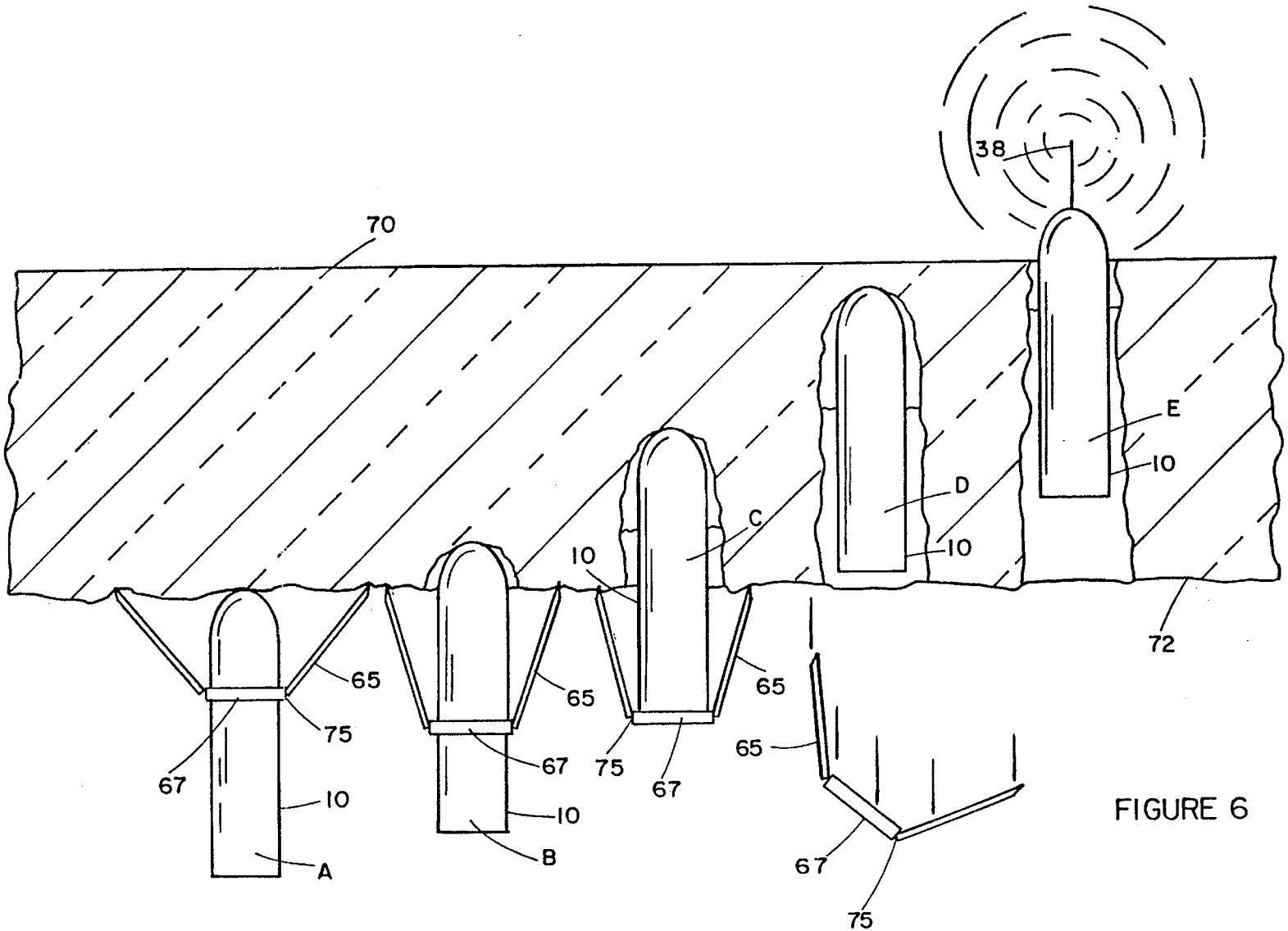
FIG. 6 shows an alternative embodiment of the subject invention boring upward through a layer of ice.

FIG. 6 illustrates the sequential operation of the embodiment of the present invention in which the collar 67 is slidably disposed in relation to the outer surface of the containment shell 10. Although the collar 67 is slidably disposed in relation to the containment shell 10, it should be understood that the collar 67 is arranged to provide sufficient friction between its inner surface and the outer surface of the containment shell 10 to require some minimal amount of force to slide it downward along the buoy away from the nose portion of the buoy. This required force is provided by the buoyancy of the signal buoy in cooperation with the fact that the legs 65 and the collar 67 are restricted from upward movement by the undersurface 72 of the body of ice 70. The sequential illustration in FIG. 6 relates to the embodiment of the collar and extendable legs shown in FIG. 4B.

In FIG. 6, buoy A represents the position of the signal buoy of the present invention as it initially makes contact with the undersurface 72 of a body of ice 70. As the buoy initially makes contact with the undersurface 72 of the body of ice 70, the feet of the extendable legs 65 are in contact with the undersurface 72 and provide a degree of attitude control which maintains the signal buoy A in a generally vertical position with the nose of the buoy in contact with the undersurface 72 of the ice.

As represented by buoy B in FIG. 6, it can be seen that the signal buoy has moved upward as ice is melted and a hole into the ice is formed. As this upward movement of the signal buoy occurs, and the containment shell 10 moves from the position indicated by buoy A to the position indicated by buoy B, the collar 67 slides downward along the outer surface of the containment shell 10. By comparing buoy A with buoy B in FIG. 6, it can be seen that the collar 67 and extendable legs 65 are in the same position, relative to the undersurface 72, in both illustrations. It can also be seen that the collar 67, relative to the nose end of the buoy, has moved along the outer cylindrical surface of the containment shell 10.

Buoy C in FIG. 6 illustrates the configuration of the collar 67 and extendable legs 65 with respect to the buoy C at a time immediately preceding the eventual separation of the collar 67 from the containment shell 10. As the buoy C moves upward into the hole formed in the ice 70, the collar continues to slide from the nose end of the buoy toward the tail end of the buoy and, eventually, the collar will disconnect from the buoy by sliding off the containment shell 10 as the buoy continues to move upward into the hole formed in the body of ice 70.

As illustrated by buoy D in FIG. 6, the collar 67 and its extendable legs 65 have completely disconnected from the buoy D and dropping away from both the buoy D and the ice toward the sea floor. After separation of the collar 67 from the buoy D, the buoy D continues its upward movement through the ice under the influence of the buoyant force provided by the sea water. Eventually, the buoy will penetrate the upper surface of the body of ice 70 and, subsequently, the antenna 38 will be extended through an opening in the nose portion of the buoy and, as illustrated by buoy E in FIG. 6, signals can be transmitted from the signal buoy.

Although FIG. 6 does not illustrate a tether, or a physical wire, connecting the signal buoy with a submarine vehicle, it should be understood that such a physical connection is contemplated within the scope of the subject invention. As described above, the present invention can be used in either a one way or two way communication procedure. When used as a one way communication signal buoy, no tether or signal wire is required to connect the signal buoy with the submarine vehicle from which it was ejected. Instead, a recorded message can be stored for later automatic broadcast by the transmitter when the buoy penetrates the upper surface of the body of ice. If two way communication is necessary, a signal line can be physically connected between the signal buoy and the submarine vehicle to permit transmission of messages from the submarine vehicle to land based or airborne receiving stations and vice versa. The use of a signal wire to connect the buoy with a submarine vehicle, although not illustrated, can be accomplished by techniques that are well known by those skilled in the art.

With continued reference to FIG. 6, it can be seen that buoy E has completely penetrated the upper surface of the body of ice 70 and the extendable antenna 38 provides additional height above the upper surface of the ice for purposes of transmitting signals to a receiving station. It should be understood that an alternative technique is possible with the present invention. Since the antenna 38 extends through an opening 40 in the nose portion of the buoy, the antenna 38 is in thermal communication with the hottest portion of the containment shell. By taking advantage of this characteristic, the antenna could be extended upward through a portion of the body of ice 70 beyond the point where the nose of the buoy is located. This permits two alternative procedures to be employed. For example, the buoy can be used to penetrate a portion of the thickness of the body of ice 70 and, after this initial penetration is accomplished, the antenna 38 can be used to achieve additional penetration to extend upward above the upper surface of the body of ice 70. As a result, the upper tip of the antenna 38 can achieve a height relative to the body of ice 70 which is equal to the sum of the penetration of the buoy itself plus the length of the antenna 38. By using this procedure, complete penetration of the body of ice 70 by the buoy is not necessary. An alternative procedure would utilize an antenna 38 which is of sufficient length to completely penetrate the thickness of the body of ice 70 with little or not actual penetration of the ice by the buoy. This procedure would begin to extend the antenna 38 from the buoy when the buoy is disposed in the configuration illustrated by buoy's A or B in FIG. 6. However, it should be realized that the required length of the antenna 38 would necessarily be longer than is necessary for the other embodiments of the present invention described above. By using the antenna 38 to penetrate a portion of the ice, the ice can be penetrated more rapidly because of the fact that the hole necessary for penetration by the antenna 38 only is much smaller than if the entire buoy penetrates the body of ice 70.

As described above, the subject invention employs a transmitter 34 that is connected in signal communication with an antenna 38 that is extendable through an opening 40 in the containment shell 10. A cover 44 is provided over the opening 40 until such time when extension of the antenna 38 is appropriate. At that time, a spring assembly 46 is used to extend the antenna 38 upward through the opening 40. To provide a cover 44 that is removable at the appropriate time for extension of the antenna through the opening 40, a preferred embodiment of the present invention uses a small nose piece made of a eutectic solder. The melting temperature of the eutectic solder is selected to prevent the solder from melting during the travel of the signal buoy from the submarine through sea water and sea ice. However, when the nose of the signal buoy penetrates the upper surface of the ice flow, the continued heat transfer by the steam rising through the riser 60 toward the nose portion of the buoy, without heat being removed by the ice, will raise the temperature of the eutectic solder to a sufficient magnitude to result in the melting of the cover 44. The melting of the cover 44 permits the spring force of the spring device 46 to extend the antenna 38 through the opening 40 and permit transmission, and possibly reception, of signals.

As the signal buoy passes away from the submarine vehicle and begins to rise upward toward the undersurface of the ice, the presence of sea water around the nose of the buoy will absorb heat from the nose portion of the buoy and prevent the eutectic solder from rising above its melting point. Then, as the nose of the buoy contacts the undersurface of the ice and begins to melt a hole through the ice, the intimate contact between the nose of the buoy and both ice and sea water will likewise prevent the temperature of the eutectic solder from rising above its melting point because of the absorption of heat from the nose of the buoy by the ice. However, when the nose of the buoy penetrates the upper surface of the ice and is no longer exposed to either sea water or ice, the continued supply of steam rising through the riser 60 will raise the temperature of the buoy's nose to a temperature that exceeds the melting point of the eutectic solder and the hole 40 will be opened by the removal of the cover 44.

The exothermic chemical reaction that takes place within the chamber 22 of the heat source 16, in a preferred embodiment of the present invention, involves the liquid metal combustion of lithium and sulfur hexafluoride. For example, as described in U.S. Pat. No. 4,634,479, the exothermic reaction can be achieved by providing an encapsulated lithium fuel comprising a shot shaped and sized body of lithium metal encapsulated in a thin layer of a predominately fluorine substituted polyolefin based polymeric material bonded thereto. The lithium metal may constitute over half of the encapsulated lithium and the polymeric material may be coated directly on the lithium metal. The polymeric material may be selected from the group consisting of polyperfluoroalkoxys, polytetrafluoroethylene, tetrafluoroethylene telomers and mixtures thereof. The shot sized and shaped bodies of lithium can be nominally spherical in shape and have a nominal diameter in the range of approximately one to twenty-five millimeters. One means for forming the lithium bodies is to form small droplets of molten lithium metal and drop them through an inert atmosphere into an inert coolant which could be, for example, mineral oil or a liquified inert gas, such as argon. The layer of polymeric material may have a varying thickness, but will generally entirely encapsulate the lithium body. The layer may be deposited directly on the body or on another coating already applied to the body. The thickness of the coating is dependent on the desired ratio of the polymeric material to the lithium in the final product.

The chamber 22 of the heat source 16, shown in FIGS. 1 and 2, is filled with the encapsulated lithium pellets and is provided with an oxidant injection means, such as the conduit 30, and an initiator 98. Preferably, because of the temperatures generated within the chamber 22 after the reaction has begun, ullage will account for approximately twenty percent of the volume within the chamber 22. This allows for substantial thermal expansion of lithium fuel pellets upon heating to operating temperature without creating high mechanical pressure on the interior of the chamber 22 due to thermal expansion of the fuel. The initiator 98 may be any desired heat source that is capable of raising the temperature of the encapsulated lithium pellets in its immediate vicinity to the temperature at which an oxidation reaction between the lithium and the polymeric coating occurs. It is believed that such a reaction begins at the melting point of lithium or, for example, approximately 357 degrees fahrenheit. At the time the initiator 98 is energized, a lithium oxidant is injected into the oxidation chamber 22 through conduit 30 from the oxidant container 26. In one embodiment of the present invention, the lithium oxidant can be sulfur hexafluoride which, in turn, may be maintained in the oxidant container 26. The oxidation reaction is initiated in the chamber 22 by an oxidation reaction between the lithium and the polymeric material coated thereon. Reaction products will include lithium fluoride and a lithium-carbon compound. The initial oxidation reaction will be almost immediately followed by a further oxidation reaction between the lithium metal and the sulfur hexafluoride. The rate at which the second reaction occurs is controlled by the rate of admission of sulfur hexafluoride into the chamber 22 through the conduit 30.

As discussed above, it may be desirable to provide some means for delaying the activation of the initiator 98 until the buoy is some predetermined distance from the submarine vehicle after ejection. Although various techniques can be employed to perform this function, one suggested technique is to provide a lanyard which is connected to an initiator activating mechanism with the other end of the lanyard being connected to the submarine vehicle. After ejection, the buoy will move away from the submarine vehicle and, eventually, the lanyard will be extended to its full length. The continued movement of the buoy away from the submarine vehicle after the lanyard has been extended to its full length will cause the initiator activating mechanism to activate the initiator 98 and begin the exothermic chemical reaction described above. It should be understood that various alternative techniques can be employed to accomplish this particular function within the scope of the present invention.

As the exothermic chemical reaction proceeds, the temperature of the heat source 16 will rise and, because of its thermal communication with the pool of liquid 20, the liquid 20 will be caused to boil and a quantity of steam will emanate from the liquid 20. Although the present invention has been described in detail with specific reference to the use of lithium and fluorine to provide the reaction within the chamber 22 of the heat source 16, it must be understood that different types of heat source may be developed which can also be used within the scope of the present invention.

Furthermore, although the present invention has been described and illustrated with considerable detail in reference to the preferred embodiment, it should be understood that alternative embodiments of the present invention are also within its scope. For example, the use of a telescoping structure in which sliding cylindrical members are used to extend the effective length and volume of the buoy in response to increased pressure within the containment shell provides a means for changing the buoyancy of the buoy after it is ejected from a submarine vessel. This technique has been employed in the preferred embodiment of the present invention because of the need to minimize the size of the buoy prior to ejection of the submarine vessel. Other embodiments of the present invention could utilize a containment shell of a fixed size with buoyancy being provided by the relative density of the buoy relative to sea water. In other words, the buoyancy of the signal buoy need not actually be increased after ejection but, instead, could be provided as an initial characteristic of the signal buoy prior to ejection. Also, although the disposition of the denser components proximate the tail end of the buoy is advantageous in maintaining the attitude of the buoy as it rises upward from the submarine vessel toward the undersurface of ice, it is recognized that alternative techniques can be employed to determine the attitude of the buoy as it proceeds into contact with the ice. Furthermore, the use of spring loaded extendable legs to provide an additional stabilizing effect in maintaining the attitude of the buoy relative to the undersurface of the ice is not a requirement of the present invention. It is recognized that alternative procedures could be employed to maintain the attitude of the buoy as it initially contacts the undersurface of the ice and, afterward, as it proceeds upward through a hole melted through the ice.

What I claim is:

1. A signal buoy, comprising:

a containment member having a first portion and a second portion, said first and second portions being generally cylindrical and arranged in coaxial relation with each other, said first and second portions being arranged in slidable relation with each other along a common axis in response to an increase of pressure within said containment member, said containment member having a first end and a second end, said second end being heavier than said first end, said containment member being generally impermeable to water and buoyant in water;

a heat source disposed within said containment member;

means for disposing a pool of liquid in thermal communication with said heat source, said pool dispensing means being disposed within said containment member;

means for directing vaporized fluid, resulting from said thermal communication of said pool of liquid and said heat source, into thermal communication with said first end of said containment member;

a transmitter disposed within said containment member;

an antenna connected in signal communication with said transmitter; and means attached to an outer surface of said containment member for maintaining said buoy in a predetermined attitude with respect to a surface of an external body when said buoy is in contact with said surface.

2. The signal buoy of claim 1, wherein:

said heat source comprises a chamber within which an exothermic chemical reaction is containable.

3. The signal buoy of claim 1, wherein:

said heat source is partially immersed in said pool of liquid, said pool of liquid being disposed in a generally annular region between said heat source and an inner surface of said containment member.

4. A signal buoy, comprising:

a containment member comprising first and a second generally cylindrical portions, said first and second portions being arranged in coaxial overlapping relation with each other, said containment member being generally impermeable to water, said first and second portions being slidable relative to each other;

a heat source disposed within said containment member, said heat source comprising a cavity shaped to contain an exothermic chemical reaction;

means for defining a space proximate said heat source and within said containment member, said space being arranged to contain a pool of liquid in thermal communication with said heat source;

a transmitter disposed within said containment member;

an antenna connected in signal communication with said transmitter; and means for directing vaporized fluid, resulting from said thermal communication between said pool of liquid and said heat source, toward a predetermined region of said containment member.

5. The buoy of claim 4, further comprising:

means for maintaining said buoy in a predetermined attitude relative to a surface of an external body.

6. The buoy of claim 5, wherein:

a preselected quantity of liquid is disposed within said defined space proximate said heat source.

7. The buoy of claim 5, wherein:

said maintaining means comprises a plurality of extendable legs.

8. The buoy of claim 7, wherein:

said exothermic chemical reaction results from a combination of lithium and fluorine.

* * * * *